US007841406B2

(12) United States Patent
Zazovsky et al.

(10) Patent No.: US 7,841,406 B2
(45) **Date of Patent: *Nov. 30, 2010**

(54) FORMATION FLUID SAMPLING APPARATUS AND METHODS

(75) Inventors: Alexander F. Zazovsky, Houston, TX (US); Colin Longfield, Houston, TX (US); Julian J. Pop, Houston, TX (US); Thomas H. Zimmerman, Houston, TX (US); John D. Sherwood, Cambridge (GB); Keith A. Burgess, Abingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 44 days.

This patent is subject to a terminal disclaimer.

(21) Appl. No.: 12/558,060

(22) Filed: Sep. 11, 2009

(65) Prior Publication Data

US 2010/0018704 A1 Jan. 28, 2010

Related U.S. Application Data

(63) Continuation of application No. 11/616,583, filed on Dec. 27, 2006, now Pat. No. 7,654,321.

(51) Int. Cl.
*E21B 49/00* (2006.01)

(52) U.S. Cl. ..... 166/264; 166/100; 175/59

(58) Field of Classification Search ..... 166/100, 166/264; 175/50, 59; 73/152.19, 152.24, 73/152.26

See application file for complete search history.

(56) References Cited

U.S. PATENT DOCUMENTS 2,441,884 A 5/1948 Mennecier
2,441,984 A 5/1948 Mennecier
3,934,468 A 1/1976 Brieger
4,860,581 A 8/1989 Zimmerman et al.
4,893,505 A 1/1990 Marsden et al.

(Continued)

FOREIGN PATENT DOCUMENTS

WO 2008036395 3/2008

OTHER PUBLICATIONS

Akram, A. H. et al., "A Model to Predict Wireline Formation Tester Sample Contamination" , Society of Petroleum Engineers, 1998, 7 Pages.

(Continued)

*Primary Examiner*—David J Bagnell
*Assistant Examiner*—Sean D Andrish
(74) *Attorney, Agent, or Firm*—Dave R. Hofman

(57) ABSTRACT

A fluid sampling system retrieves a formation fluid sample from a formation surrounding a wellbore extending along a wellbore axis, wherein the formation has a virgin fluid and a contaminated fluid therein. The system includes a sample inlet, a first guard inlet positioned adjacent to the sample inlet and spaced from the sample inlet in a first direction along the wellbore axis, and a second guard inlet positioned adjacent to the sample inlet and spaced from the sample inlet in a second, opposite direction along the wellbore axis. At least one cleanup flowline is fluidly connected to the first and second guard inlets for passing contaminated fluid, and an evaluation flowline is fluidly connected to the sample inlet for collecting virgin fluid.

1 Claim, 8 Drawing Sheets

U.S. PATENT DOCUMENTS

| | | | |
|---|---|---|---|
| 4,936,139 | A | 6/1990 | Zimmerman et al. |
| 4,951,749 | A | 8/1990 | Carroll |
| 5,279,153 | A | 1/1994 | Dussan et al. |
| 5,549,159 | A | 8/1996 | Shwe et al. |
| 5,622,223 | A | 4/1997 | Vasquez |
| 6,230,557 | B1 | 5/2001 | Ciglenec |
| 6,301,959 | B1 | 10/2001 | Hrametz et al. |
| 6,585,045 | B2 | 7/2003 | Lee et al. |
| 6,609,568 | B2 | 8/2003 | Krueger et al. |
| 6,719,049 | B2 | 4/2004 | Sherwood et al. |
| 6,729,399 | B2 | 5/2004 | Follini et al. |
| 7,090,012 | B2 | 8/2006 | Hill et al. |
| 7,114,385 | B2 | 10/2006 | Fisseler et al. |
| 7,124,819 | B2 | 10/2006 | Ciglenec et al. |
| 7,260,985 | B2 | 8/2007 | Gilbert et al. |
| 2004/0000433 | A1 | 1/2004 | Hill et al. |
| 2004/0173351 | A1 | 9/2004 | Fox et al. |
| 2006/0042793 | A1 | 3/2006 | Del Campo et al. |
| 2006/0075813 | A1 | 4/2006 | Fisseler et al. |
| 2006/0076132 | A1 | 4/2006 | Nold et al. |
| 2006/0117842 | A1 | 6/2006 | Ramakrishnan |

OTHER PUBLICATIONS

Schlumberger, "MDT Modular Formation Dynamics Tester", Jun. 2002, 11 Pages.

Crombie et al., "Innovations in Wireline Fluid Sampling". Oilfield Review, Autumn 1998, 16 Pages.

AH Akram et al., "A Model to Predict Wireline Formation Tester Sample Contamination," SPE 48959, 1998 SPE Ann. Tech. Conf. & Exhib., New Orleans LA, Sep. 27-30, 1998 (pp. 27-33).

A Crombie et al., "Innovations in Wireline Fluid Sampling," Oilfield Review, Autumn 1998 )pp. 26-41).

FORMATION FLUID SAMPLING APPARATUS AND METHODS

CROSS-REFERENCE TO RELATED APPLICATIONS

This is a continuation application of U.S. patent application Ser. No. 11/616,583, filed Dec. 27, 2006, now issued as U.S. Pat. No. 7,654,321.

BACKGROUND

1. Technical Field

This disclosure generally relates to investigations of subterranean formations, and more particularly to apparatus and methods for reducing the contamination of formation fluids drawn into a downhole formation testing and sampling tool.

2. Description of the Related Art

Wells are generally drilled into the ground or ocean bed to recover natural deposits of oil and gas, as well as other desirable materials that are trapped in geological formations in the Earth's crust. A well is typically drilled using a drill bit attached to the lower end of a "drill string." Drilling fluid, or "mud," is typically pumped down through the drill string to the drill bit. The drilling fluid lubricates and cools the drill bit, and it carries drill cuttings back to the surface in the annulus between the drill string and the wellbore wall.

For successful oil and gas exploration, it is necessary to have information about the subsurface formations that are penetrated by a wellbore. For example, one aspect of standard formation evaluation relates to the measurements of the formation pressure and formation permeability. These measurements are essential to predicting the production capacity and production lifetime of a subsurface formation.

One technique for measuring formation and fluid properties includes lowering a "wireline" tool into the well to measure formation properties. A wireline tool is a measurement tool that is suspended from a wireline in electrical communication with a control system disposed on the surface. The tool is lowered into a well so that it can measure formation properties at desired depths. A typical wireline tool may include a probe that may be pressed against the wellbore wall to establish fluid communication with the formation. This type of wireline tool is often called a "formation tester." Using the probe, a formation tester measures the pressure of the formation fluids, generates a pressure pulse, which is used to determine the formation permeability. The formation tester tool also typically withdraws a sample of the formation fluid that is either subsequently transported to the surface for analysis or analyzed downhole.

In order to use any wireline tool, whether the tool be a resistivity, porosity or formation testing tool, the drill string must be removed from the well so that the tool can be lowered into the well. This is called a "trip" uphole. Further, the wireline tools must be lowered to the zone of interest, generally at or near the bottom of the hole. A combination of removing the drill string and lowering the wireline tools downhole are time-consuming measures and can take up to several hours, depending upon the depth of the wellbore. Because of the great expense and rig time required to "trip" the drill pipe and lower the wireline tools down the wellbore, wireline tools are generally used only when the information is absolutely needed or when the drill string is tripped for another reason, such as changing the drill bit. Examples of wireline formation testers are described, for example, in U.S. Pat. Nos. 3,934,468; 4,860,581; 4,893,505; 4,936,139; and 5,622,223.

To avoid or minimize the downtime associated with tripping the drill string, another technique for measuring formation properties has been developed in which tools and devices are positioned near the drill bit in a drilling system. Thus, formation measurements are made during the drilling process and the terminology generally used in the art is "MWD" (measurement-while-drilling) and "LWD" (logging-while-drilling). A variety of downhole MWD and LWD drilling tools are commercially available.

MWD typically refers to measuring the drill bit trajectory as well as wellbore temperature and pressure, while LWD refers to measuring formation parameters or properties, such as resistivity, porosity, permeability, and sonic velocity, among others. Real-time data, such as the formation pressure, allows the drilling company to make decisions about drilling mud weight and composition, as well as decisions about drilling rate and weight-on-bit, during the drilling process. While LWD and MWD have different meanings to those of ordinary skill in the art, that distinction is not germane to this disclosure, and therefore this disclosure does not distinguish between the two terms.

Formation evaluation, whether during a wireline operation or while drilling, often requires that fluid from the formation be drawn into a downhole tool for testing and/or sampling. Various sampling devices, typically referred to as probes, are extended from the downhole tool to establish fluid communication with the formation surrounding the wellbore and to draw fluid into the downhole tool. A typical probe is a circular element extended from the downhole tool and positioned against the sidewall of the wellbore. A rubber packer at the end of the probe is used to create a seal with the wellbore sidewall. Another device used to form a seal with the wellbore sidewall is referred to as a dual packer. With a dual packer, two elastomeric rings expand radially about the tool to isolate a portion of the wellbore therebetween. The rings form a seal with the wellbore wall and permit fluid to be drawn into the isolated portion of the wellbore and into an inlet in the downhole tool.

The mudcake lining the wellbore is often useful in assisting the probe and/or dual packers in making the seal with the wellbore wall. Once the seal is made, fluid from the formation is drawn into the downhole tool through an inlet by lowering the pressure in the downhole tool. Examples of probes and/or packers used in downhole tools are described in U.S. Pat. Nos. 6,301,959; 4,860,581; 4,936,139; 6,585,045; 6,609,568 and 6,719,049 and U.S. Patent Application Publication No. 2004/0000433.

Reservoir evaluation can be performed on fluids drawn into the downhole tool while the tool remains downhole. Techniques currently exist for performing various measurements, pretests and/or sample collection of fluids that enter the downhole tool. However, it has been discovered that when the formation fluid passes into the downhole tool, various contaminants, such as wellbore fluids and/or drilling mud primarily in the form of mud filtrate from the "invaded zone" of the formation, may enter the tool with the formation fluids. The invaded zone is the portion of the formation radially beyond the mudcake layer lining the wellbore where mud filtrate has penetrated the formation leaving the mudcake layer behind. These mud filtrate contaminates may affect the quality of measurements and/or samples of the formation fluids. Moreover, contamination may cause costly delays in the wellbore operations by requiring additional time for obtaining test results and/or samples representative of the formation fluid. Additionally, such problems may yield false results that are erroneous and/or unusable. Thus, it is desirable that the formation fluid entering into the downhole tool be sufficiently 'clean' or 'virgin' for valid testing. In other words, the formation fluid should have little or no contamination.

Attempts have been made to eliminate contaminates from entering the downhole tool with the formation fluid. For example, as depicted in U.S. Pat. No. 4,951,749, filters have been positioned in probes to block contaminates from entering the downhole tool with the formation fluid. Additionally, as shown in U.S. Pat. No. 6,301,959, a probe is provided with a guard ring to divert contaminated fluids away from clean fluid as it enters the probe. More recently, U.S. Patent Application Publication No. 2006/0042793 discloses a central sample probe with an annular "guard" probe extending about an outer periphery of the sample probe, in an effort to divert contaminated fluids away from the sample probe.

Despite the existence of techniques for performing formation evaluation and for attempting to deal with contamination, there remains a need to manipulate the flow of fluids through the downhole tool to reduce contamination as it enters and/or passes through the downhole tool. It is desirable that such techniques are capable of diverting contaminants away from clean fluid.

Additionally, in while-drilling applications, the measuring apparatus is exposed to the extreme forces present during drilling operations. Any apparatus extending transversely through the wall of a drill string structure, such as a probe, will also weaken that structure. Thus, it is desirable to design probe apparatus so that it not only minimizes and/or withstands the while-drilling forces, but also minimizes any structural weaknesses in the drill string caused by the presence of the probe apparatus.

SUMMARY OF THE DISCLOSURE

A fluid sampling system is provided for retrieving a formation fluid sample from a formation surrounding a wellbore extending along a wellbore axis, the formation having a virgin fluid and a contaminated fluid therein. The system includes a sample inlet, a first guard inlet positioned adjacent to the sample inlet and spaced from the sample inlet in a first direction along the wellbore axis, and a second guard inlet positioned adjacent to the sample inlet and spaced from the sample inlet in a second, opposite direction along the wellbore axis. At least one cleanup flowline is fluidly connected to the first and second guard inlets for passing contaminated fluid, and an evaluation flowline is fluidly connected to the sample inlet for collecting virgin fluid.

In a refinement, the sample inlet is provided on a sample probe assembly including a sample inlet extension mechanism, the first guard inlet is provided on a first guard probe assembly including a first guard inlet extension mechanism, and the second guard inlet is provided on a second guard probe assembly including a second guard inlet extension mechanism, wherein the sample inlet, first guard inlet, and second guard inlet extension mechanisms are operable independently of one another.

In a related refinement, the sample probe assembly includes a sample inlet packer completely surrounding an outer periphery of the sample inlet, the first guard probe assembly includes a first guard inlet packer completely surrounding an outer periphery of the first guard inlet, and the second guard probe assembly includes a second guard inlet packer completely surrounding an outer periphery of the second guard inlet.

In a further refinement, the sample inlet packer, first guard inlet packer, and second guard inlet packer are formed as segments of a composite packer having a substantially contiguous outer periphery.

In a refinement, the sample probe assembly, first guard probe assembly, and second guard probe assembly are provided on a stabilizing blade of a drilling tool.

In yet another refinement, the sample inlet, first guard inlet, and second guard inlet are integrally provided on a single probe assembly including an inlet extension mechanism.

In still another refinement, the inlet packer includes a first packer segment disposed between the sample inlet and the first guard inlet and a second packer segment disposed between the sample inlet and the second guard inlet.

In a related refinement, the first and second packer segments further comprise a reinforcement material.

In a refinement, an exterior face of the inlet packer includes a guard channel.

In a further refinement, the system is associated with a wireline tool.

In another refinement, the system is associated with a drilling tool.

A probe assembly is also disclosed for use with a fluid sampling system to retrieve a formation fluid sample from a formation surrounding a wellbore extending along a wellbore axis, the formation having a virgin fluid and a contaminated fluid therein. The probe assembly includes an inlet extension mechanism and a sample inlet coupled to the inlet extension mechanism. A first guard inlet is coupled to the inlet extension mechanism, the first guard inlet being positioned adjacent to the sample inlet and spaced from the sample inlet in a first direction parallel to the wellbore axis. A second guard inlet is coupled to the inlet extension mechanism, the second guard inlet being positioned adjacent to the sample inlet and spaced from the sample inlet in a second, opposite direction parallel to the wellbore axis. An inlet packer completely surrounds outer peripheries of the sample inlet, first guard inlet, and second guard inlet.

In a related refinement, the probe packer includes a first packer segment disposed between the sample probe and the first guard probe and a second packer segment disposed between the sample probe and the second guard probe, wherein the first and second packer segments further comprise a reinforcement material.

In a further refinement, an exterior face of the probe packer includes a guard channel.

In another refinement, the guard channel includes a central ring section completely surrounding an outer periphery of the sample probe, a first guard ring section completely surrounding an outer periphery of the first guard probe, a second guard ring section completely surrounding an outer periphery of the second guard probe, a first link section extending between the central ring section and the first guard ring section, and a second link section extending between the central ring section and the second guard ring section.

In yet another refinement, the guard channel includes a guard ring section completely surrounding an outer periphery of the first guard probe and at least a first wing section connected to and extending away from the guard ring section.

In still another refinement, the guard channel further includes a second wing section connecting to and extending away from the guard ring section.

In a refinement, a second guard channel is provided having a guard ring section completely surrounding an outer periphery of the second guard probe and at least a first wing section connected to and extending away from the guard ring section.

In a related refinement, the guard channel is defined by a channel insert coupled to the probe packer.

In a further refinement, the channel insert is mechanically coupled to the probe packer.

In yet another refinement, the sample inlet, first guard inlet, and second guard inlet are pivotably coupled to the inlet extension mechanism.

A downhole tool is disclosed that is connected to a drill string positioned in a wellbore penetrating a subterranean formation along a wellbore axis. The tool includes a drilling collar having at least one stabilizing blade defining a blade axis, an inlet extension mechanism housed within the stabilizing blade, and a probe assembly coupled to the inlet extension mechanism. The probe assembly comprises a sample inlet having a mouth portion with a first profile dimension in a direction parallel to the blade axis and a second profile dimension in a direction perpendicular to the blade axis, in which the first profile dimension is greater than the second profile dimension. An inner packer completely surrounds an outer periphery of the sample inlet, a guard inlet extends completely around an outer periphery of the inner packer, and an outer packer completely surrounds an outer periphery of the guard inlet.

In a refinement, the probe assembly is pivotably coupled to the inlet extension mechanism.

In a further refinement, the mouth portion has a generally oval shape cross-sectional profile, with the first profile dimension comprising a major axis and the second profile dimension comprising a minor axis.

In yet another refinement, the second profile dimension is less than approximately 3.5 inches.

BRIEF DESCRIPTION OF THE DRAWINGS

For a more complete understanding of the disclosed methods and apparatuses, reference should be made to the embodiment illustrated in greater detail on the accompanying drawings, wherein.

It should be understood that the drawings are not necessarily to scale and that the disclosed embodiments are sometimes illustrated diagrammatically and in partial views. In certain instances, details which are not necessary for an understanding of the disclosed methods and apparatuses or which render other details difficult to perceive may have been omitted. It should be understood, of course, that this disclosure is not limited to the particular embodiments illustrated herein.

DETAILED DESCRIPTION

This disclosure relates to probe assemblies and configurations described below that may be used with a downhole tool, either in a drilling environment or in a wireline environment. The apparatus and methods disclosed herein reduce the contamination of formation fluid samples. In some refinements, this disclosure relates to the relative positioning of multiple, independently operable probe assemblies. In one or more other refinements, a fluid sampling system includes a single assembly having multiple probes. In addition, a probe configuration particularly suited to while-drilling applications is disclosed.

The phrase "formation evaluation while drilling" refers to various sampling and testing operations that may be performed during the drilling process, such as sample collection, fluid pump out, pretests, pressure tests, fluid analysis, and resistivity tests, among others. It is noted that "formation evaluation while drilling" does not necessarily mean that the measurements are made while the drill bit is actually cutting through the formation. For example, sample collection and pump out are usually performed during brief stops in the drilling process. That is, the rotation of the drill bit is briefly stopped so that the measurements may be made. Drilling may continue once the measurements are made. Even in embodiments where measurements are only made after drilling is stopped, the measurements may still be made without having to trip the drill string.

Figure 1:
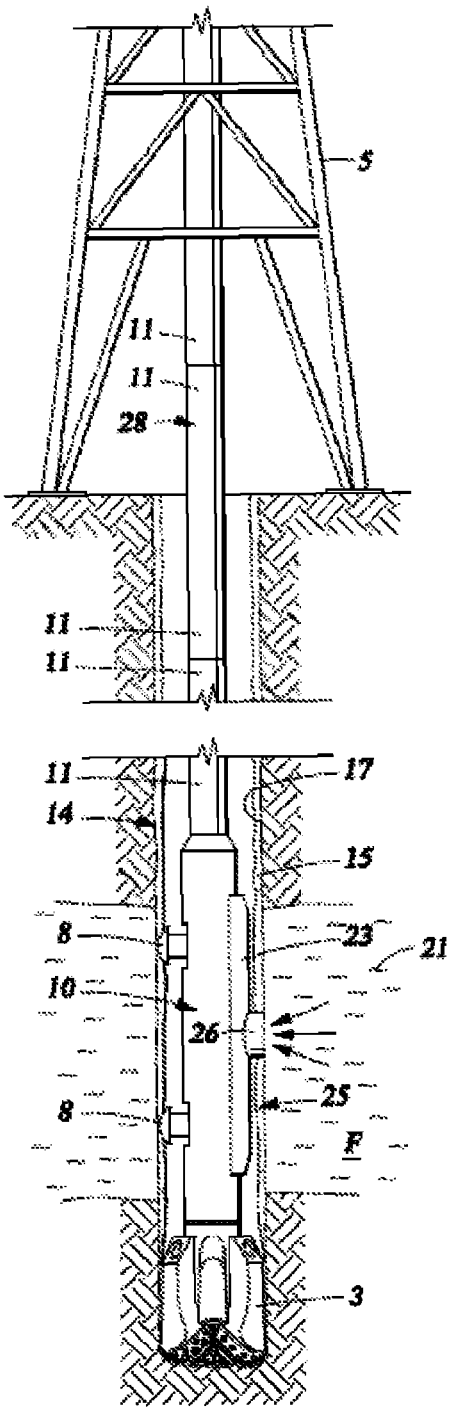
FIG. 1 is a schematic view, partially in cross-section, of a downhole tool with a probe assembly according to the present disclosure, in which the downhole tool is a downhole drilling tool.
Figure 2:
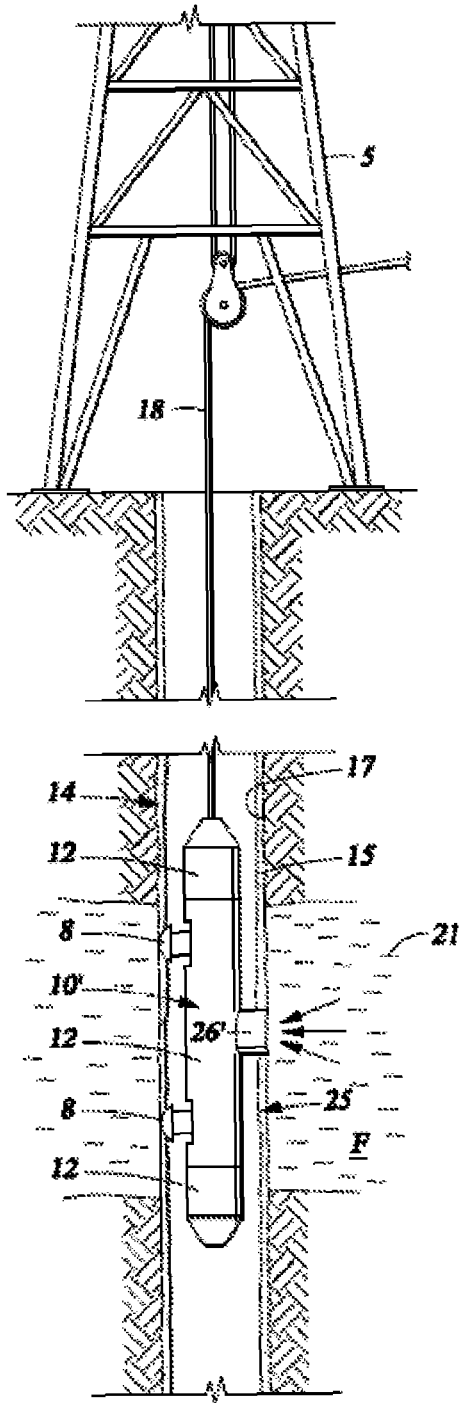
FIG. 2 is a schematic view, partially in cross-section, of a downhole tool with a probe assembly according to the present disclosure, in which the downhole tool is a wireline tool.

In the exemplary embodiments, a probe assembly according to the present disclosure is carried by a downhole tool, such as the drilling tool 10 of FIG. 1 or the wireline tool 10' of FIG. 2. The probe assembly may also be used in other downhole tools adapted to draw fluid therein, such as coiled tubing, casing drilling, and other variations of downhole tools.

FIG. 1 depicts a downhole drilling tool 10 deployed from a rig 5 and advanced into the earth to form a wellbore 14. The wellbore penetrates a subterranean formation F containing a formation fluid 21. The downhole drilling tool is suspended from the drilling rig by one or more drill collars 11 that form a drill string 28. "Mud" is pumped through the drill string 28 and out bit 3 of the drilling tool 10. The mud is pumped back up through the wellbore and to the surface for filtering and recirculation. As the mud passes through the wellbore, it forms a mud layer or mudcake 15 along the wellbore wall 17. A portion of the mud infiltrates the formation to form an invaded zone 25 of the formation F.

In the illustrated embodiment, the drilling tool 10 is provided with a probe 26 for establishing fluid communication with the formation F and drawing the fluid 21 into the downhole tool, as indicated by the arrows. As shown in FIG. 1, the probe is positioned in a stabilizer blade 23 of the drilling tool and extended therefrom to engage the wellbore wall. The stabilizer blade 23 comprises one or more blades that are in contact with the wellbore wall to limit "wobble" of the drill bit 3. "Wobble" is the tendency of the drill string, as it rotates, to deviate from the axis of the wellbore 14 and cause the drill bit to change direction. Advantageously, a stabilizer blade 23 is already in contact with the wellbore wall, thus requiring less extension of a probe to establish fluid communication with the formation fluids if the probe is disposed in the stabilizer blade 23.

Fluid drawn into the downhole tool using the probe 26 may be measured to determine, for example, pretest and/or pressure parameters. Additionally, the downhole tool may be provided with devices, such as sample chambers, for collecting fluid samples for retrieval at the surface. Backup pistons 8 may also be provided to assist in applying force to push the drilling tool and/or probe against the wellbore wall. The drilling tool may be of a variety of drilling tools, such as Measurement-While-Drilling ("MWD"), Logging-While-Drilling ("LWD"), casing drilling, or other system. An example of a drilling tool usable for performing various downhole tests is depicted in U.S. patent application Ser. No. 10/707,152, filed on Nov. 24, 2003, the entire contents of which are hereby incorporated by reference.

The downhole drilling tool 10 may be removed from the wellbore and a wireline tool 10' (FIG. 2) may be lowered into the wellbore via a wireline cable 18. An example of a wireline tool capable of sampling and/or testing is depicted in U.S. Pat. Nos. 4,936,139 and 4,860,581, the entire contents of which are hereby incorporated by reference. The downhole tool 10' is deployable into borehole 14 and suspended therein with a conventional wireline 18, or conductor or conventional tubing or coiled tubing, below the rig 5. The illustrated tool 10' is provided with various modules and/or components 12 including, but not limited to, a probe 26' for establishing fluid communication with the formation F and drawing the fluid 21 into the downhole tool as shown by the arrows. Backup pistons 8 may be provided to further thrust the downhole tool against the wellbore wall and assist the probe in engaging the wellbore wall. The tools of FIGS. 1 and 2 may be modular as shown in FIG. 2 or unitary as shown in FIG. 1, or combinations thereof.

Figure 3:
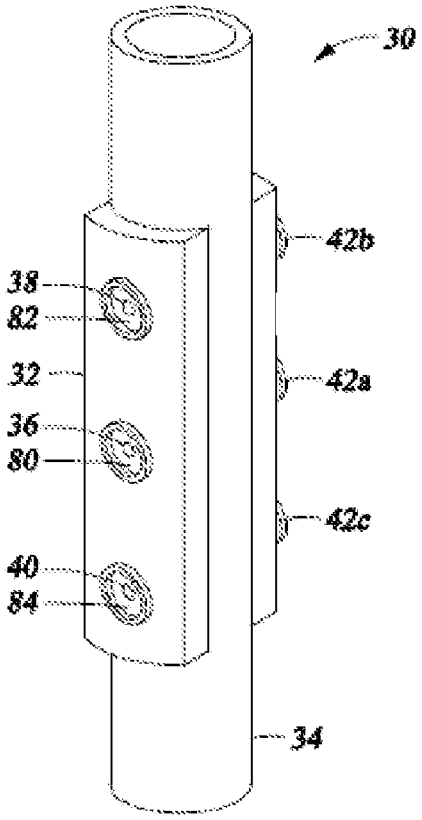
FIG. 3 illustrates one embodiment of a formation fluid sampling system made in accordance with this disclosure.

Turning to FIG. 3, a probe assembly 30 is recessed within a stabilizing blade 32 of a drill collar 34. The probe assembly 30 includes a sample inlet 36, a first guard inlet 38, and a second guard inlet 40. Each of the inlets 36, 38, 40 is oriented generally transversely to a longitudinal axis of the drill collar 34 and is normally in a retracted position so that the inlets 36, 38, 40 are housed within one or more cavities formed in the stabilizing blade 32. A dedicated probe extension mechanism, such as a hydraulic as described in U.S. Pat. Nos. 6,230,557; 4,860,581; and 4,936,139 commonly assigned to the assignee of the present application, the entire contents of which are hereby incorporated by reference, is operatively coupled to each inlet 36, 38, 40 to selectively and independently move the associated inlet to an extended position. In the extended position, the inlet 36, 38, or 40 may extend outside of the cavity to place the inlet in better position to contact the wellbore wall 17. Back up pistons 42*a-c* are extendible to move the probe assembly 30 toward the formation F.

While the exemplary embodiment describes inlets that are extendable, it will be appreciated that the inlets may be non-extendable and therefore fixed with respect to the position of the drill collar 34. In addition, the probe assembly 30 may include a protector which provides mechanical protection to the inlets during drilling and/or tripping operations and which provides mechanical protection to the mudcake against erosion generated by flowing mud. One such protector is described in U.S. Pat. No. 6,729,399 commonly assigned to the assignee of the present application, the entire contents of which are hereby incorporated by reference.

Figure 4:
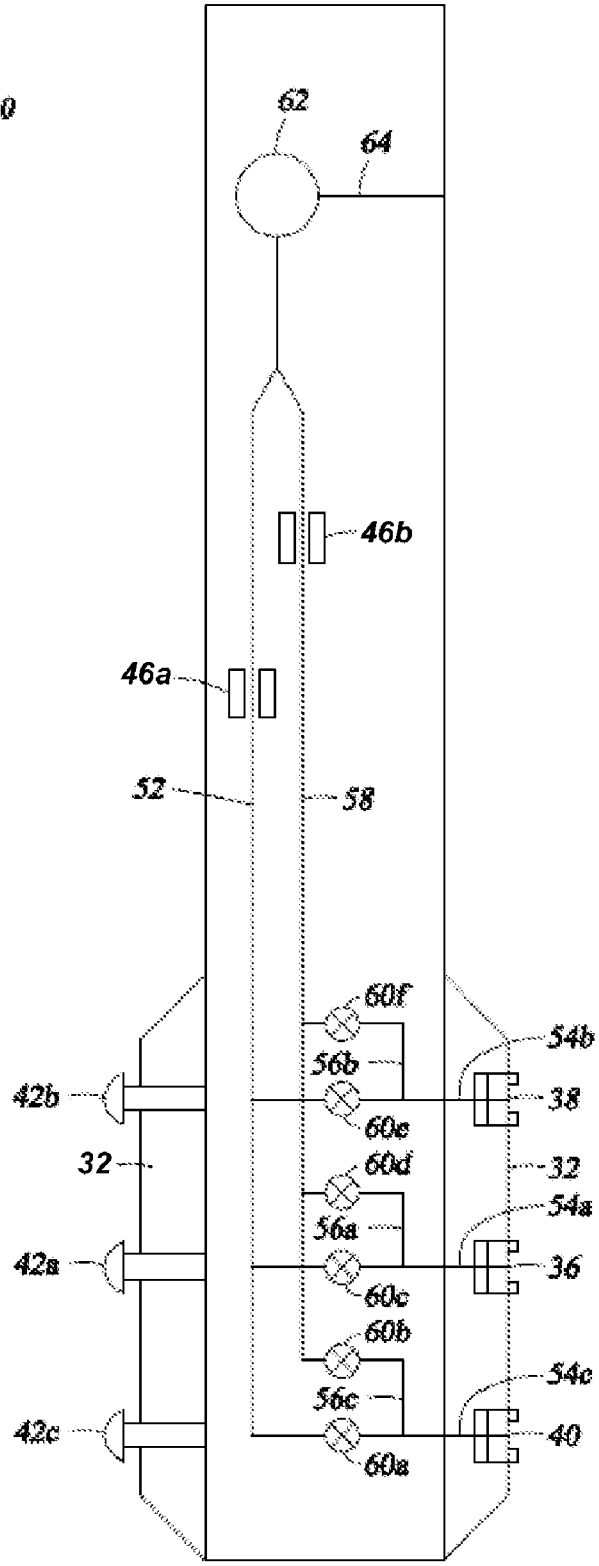
FIG. 4 is a schematic sectional view of the formation fluid sampling system of FIG. 3.

As shown in FIG. 4, fluid flowlines are connected to the inlets for passing either waste fluid or clean fluid. In the illustrated embodiment, sample inlet 36 is fluidly connected to an evaluation flowline 52 by an inlet flowline 54*a*. A bypass flowline 56*a* fluidly communicates between the sample probe 38 and a clean up flowline 58. The first guard inlet 38 is also fluidly connected to the evaluation and clean up flowlines 52, 58 by an inlet flowline 54*b* and a bypass flowline 56*b*, respectively. Similarly, the second guard inlet 40 is in fluid communication with the evaluation and clean up flowlines 52, 58 by an inlet flowline 54*c* and a bypass flowline 56*c*. Valves 60*a-f* are provided in the inlet and bypass flowlines 54, 56 to direct fluid flow to the evaluation and clean up flowlines 52, 58, as desired. Fluid sensors, such as optical fluid analyzers 46*a*, 46*b*, are associated with the flowlines 52, 58 to provide feedback regarding characteristics or other information regarding the fluid passing through the flowlines.

A pump 62 is fluidly coupled to the evaluation and clean up flowlines 52, 58. A sample storage assembly (not shown) may fluidly communicate with the evaluation flowline 52 upstream of the point where the evaluation flowline 52 and clean up flowline 58 are connected, to provide means for collecting a clean fluid sample. A pump discharge flowline 64 may communicate between the pump and the wellbore 14 for discharging contaminated formation fluid. The pump 62 and valves 60*a-f* may be operated in various manners to clear contaminated formation fluid from the immediate area of the probes 36, 38, 40 and to draw clean formation fluid into the evaluation flowline 52, such as the methods disclosed in U.S. Patent Application Publication No. 2006-0042793, the entire contents of which are hereby incorporated by reference.

Each of the inlets 36, 38, 40 of the probe assembly 30 includes a packer for sealing with the wellbore wall 17. As illustrated in FIGS. 3 and 4, a sample inlet packer 80 is provided that completely surrounds an outer periphery of the sample inlet 36. Similarly, first and second guard inlet packers 82, 84 completely surround outer peripheries of the first and second guard inlets 38, 40, respectively.

The inlets 36, 38, 40 are positioned relative to one another to reduce the amount of contaminants that reach the sample inlet 36. In the illustrated embodiment, the first guard inlet 38 is positioned adjacent to and above the sample inlet 36 while the second guard inlet 40 is positioned adjacent to and below the sample inlet 36. This arrangement of inlets minimizes or prevents fluid from the invaded zone from entering the sample inlet 36. The invaded zone 25 is the area where mud filtrate has entered the formation F radially from the wellbore 14, leaving a layer of mudcake lining the wellbore wall 17. Once filtrate-laden formation fluid from the invaded zone has been removed from the circumferential area surrounding the inlets 36, 38, 40, the first and second guard inlets 38, 40 prevent mud filtrate and contaminated fluid from migrating axially toward the sample inlet 36. As a result, the sample inlet 36 retrieves formation fluid having little or no filtrate contamination.

The distance between the inlets 36, 38, 40 must balance performance and structural considerations. On the one hand, it is desirable to locate the inlets 36, 38, 40 as close to one another as possible, thereby to minimize the volume of fluid that must be initially pumped from the formation before a clean fluid flow is obtained at the sample inlet 36. On the other hand, each inlet 36, 38, 40 requires an aperture to be formed through an exterior of the drilling tool. In while-drilling applications, the drill collar carrying the probe assembly must be structurally sound to withstand the forces experienced during drilling operations. In addition, farther spaced inlets 36, 38, 40 reduce the chance of cross-contamination of flow streams into each inlet. As a practical matter, therefore, it is preferable to have a space between each adjacent pair of inlets of at least one inlet diameter.

Figure 5:
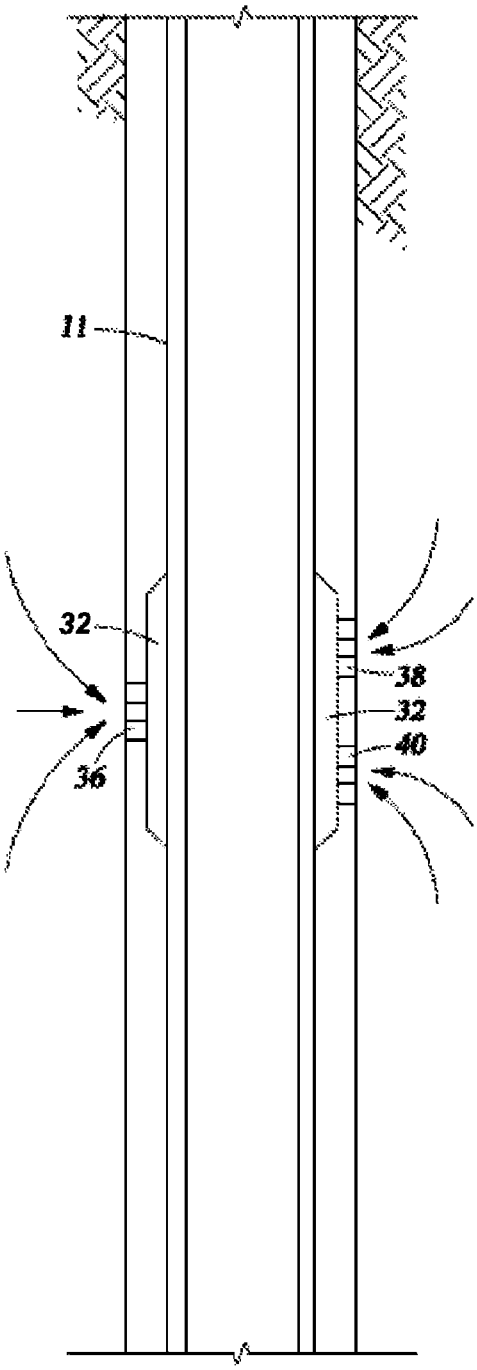
FIGS. 5 and 6 schematically illustrate alternative probe arrangements for a formation fluid sampling system similar to that of FIG. 3.
Figure 6:
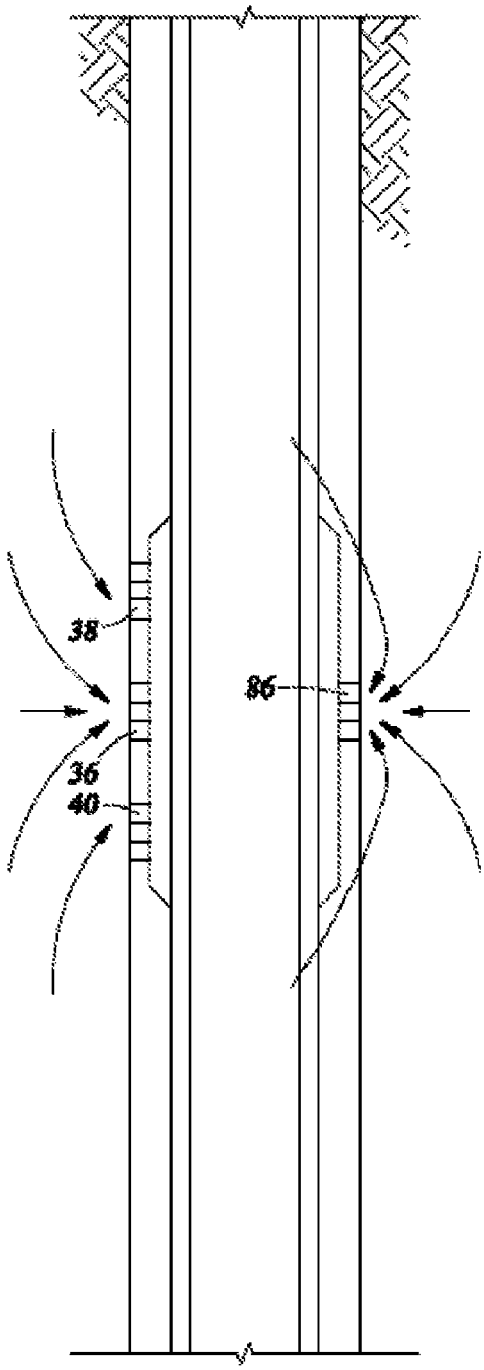

Various alternative inlet configurations and combinations may be used without departing from the scope of this disclosure. For example, instead of providing vertically aligned inlets as shown in FIGS. 3 and 4, the sample inlet 36 may be azimuthally offset from the first and second guard inlets 38, 40, as shown in FIG. 5. In this embodiment, the sample inlet 36 extends from a first side of the drill collar 11 while the first and second guard inlets 38, 40 extend from a second, opposite side of the drill collar 11. This configuration is still effective to prevent filtrate from reaching the sample inlet 36 because the first and second guard inlets 38, 40 remove fluid from an area of the formation lying within an annular band surrounding each inlet. Alternatively, an additional guard inlet 86 may be provided as shown in FIG. 6.

Figure 7:
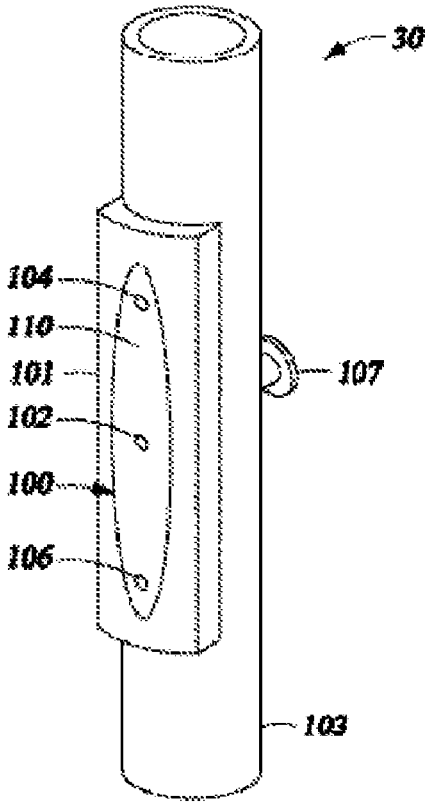
FIG. 7 illustrates an alternative formation fluid sampling systems.
Figure 8:
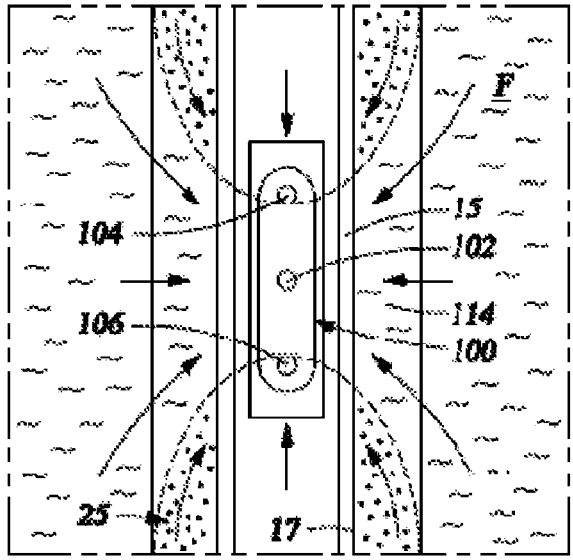
FIG. 8 schematically illustrates fluid flow during use of the formation fluid sampling system of FIG. 7.

An alternative probe assembly embodiment having multiple inlets actuated by a single extension mechanism is illustrated in FIGS. 7 and 8. A probe assembly 100 is illustrated as recessed within a stabilizer blade 101 of a drill collar 103. The probe assembly 100 includes sample inlet 102, a first guard inlet 104, and a second guard inlet 106. The inlets 102, 104, 106 may be operatively coupled to a single extension mechanism that simultaneously advances and retracts the probes or, alternatively, the inlets may be non-extendable. The probe assembly 100 further includes a single packer 110 that completely surrounds outer peripheries of the sample inlet 102, first guard inlet 104, and second guard inlet 106. The inlets 102, 104, 106 are generally vertically aligned with the sample inlet 102 positioned in between the first and second guard inlets 104, 106. A back up piston 107 is provided for positioning the assembly 100 adjacent the wellbore wall 17.

In operation, the drill collar 103 carrying the probe assembly 100 is positioned within the wellbore 14, as illustrated in FIG. 8. To perform testing, the probe assembly 100 is positioned adjacent the wellbore wall 17, either by extending the inlets 102, 104, 106 away from the drill collar 103 or by extending the back up piston 107, or both, until the packer 110 contacts the wellbore wall 17 and forms a seal with the mudcake 15. As discussed above, the drilling mud seeps into the formation through the wellbore wall 17 and creates an invaded zone 25 about the wellbore 14, leaving a layer of mudcake 15 that lines the wellbore wall 17. The invaded zone 25 contains mud and other wellbore fluids that contaminate the surrounding formation, including the formation F having a zone of clean formation fluid 114 contained therein. As illustrated in FIG. 8, operation of the probe assembly 100 will remove contaminated formation fluid from the area immediately surrounding the inlets 102, 104, 106. During operation, filtrate may continue to migrate axially through the invaded zone 25, in either the upward or downward direction. Any such migrant filtrate will be removed by the first and second guard inlets 104, 106 prior to reaching the sample inlet 102, thereby allowing the sample inlet 102 to retrieve substantially clean formation fluid samples.

Figure 9:
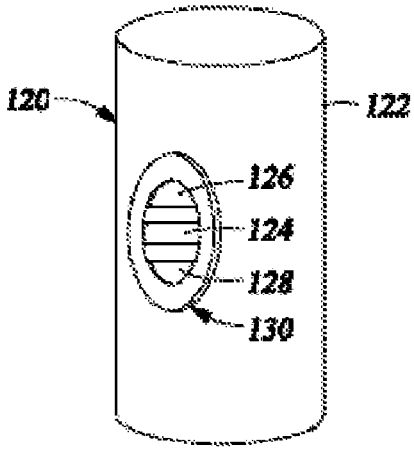
FIG. 9 illustrates a further alternative formation fluid sampling system.
Figure 10:
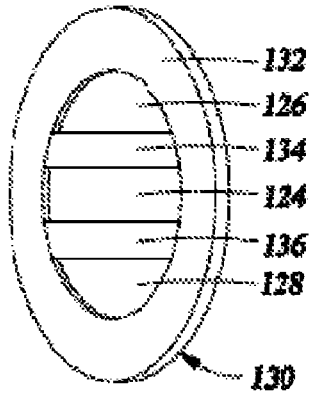
FIG. 10 is a detailed view of a packer employed in the formation fluid sampling system of FIG. 9.

FIGS. 9 and 10 illustrate an alternative embodiment of a single probe assembly having multiple inlets. A probe assembly 120 is shown coupled to a drill collar 122. The probe assembly 120 includes a sample inlet 124, a first guard inlet 126, and a second guard inlet 128. A single packer 130 is provided having an outer portion 132 surrounding the exterior portions of the sample inlet 124, first guard inlet 126, and second guard inlet 128. The packer 130 also includes a first interior segment 134 extending between the sample inlet 124 and the first guard inlet 126, and a second interior segment 136 extending between the sample inlet 124 and the second guard inlet 128. In the illustrated embodiment, the exterior peripheries of the inlets 124, 126, 128 trace an oval shape that is interrupted by the first and second packer segments 134, 136. In this arrangement, the inlets 124, 126, 128 are positioned more closely to one another in the vertical direction, which may improve the clarity of the formation fluid sample retrieved through the sample probe 124.

The first and second packer segments 134, 136 may be reinforced to improve their resistance to pressure differentials. A reinforcement material, such as a metal, composite, or other high strength material, may be molded into the first and second segments 134, 136 of the rubber packer 130. The first and second segments 134, 136 prevent filtrate from migrating vertically into the sample inlet 124. While the left and right side sections of the sample inlet 124 are left relatively unprotected, it has been found that the circumferential area surrounding the sample inlet 124 remains relatively clear of filtrate once it has been initially evacuated, and that the first and second guard inlets 126, 128 prevent vertical migration into this area of the formation. Additionally, the sample inlet 124 configuration illustrated in FIGS. 9 and 10 allow these unprotected side sections to be fairly small, thereby further minimizing the potential for filtrate or formation fluid contaminated with filtrate to reach the sample inlet 124. While the inlets 124, 126, 128 are shown with shapes that fit within an oval shaped packer outer portion 132, it will be appreciated that other shapes may be used without departing from the scope of this disclosure.

Figure 11:
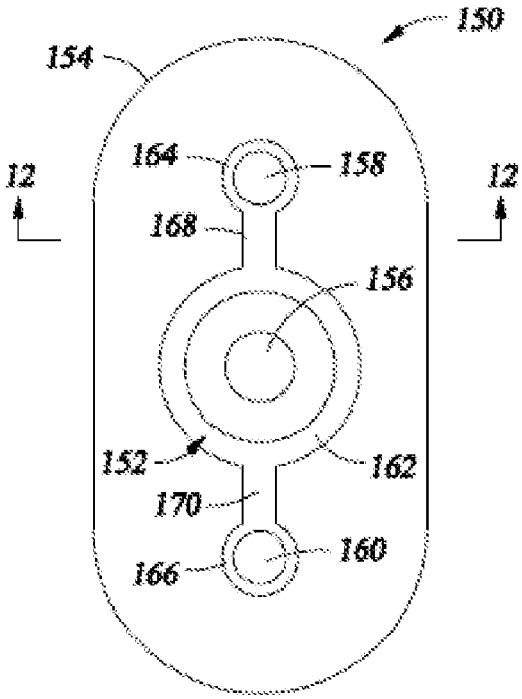
FIG. 11 is a plan view of yet another embodiment of a formation fluid sampling system made in accordance with this disclosure.
Figure 12:
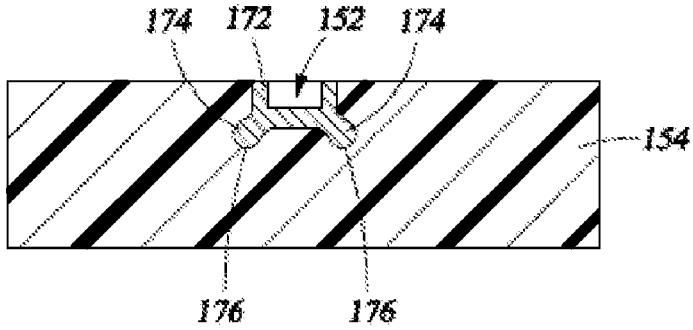
FIG. 12 is a cross-sectional view of the formation fluid sampling system taken along line A-A of FIG. 11.

A further refinement is illustrated in FIGS. 11 and 12, which show a probe assembly 150 with a guard channel 152 formed in an exterior face of a packer 154. The probe assembly 150 includes a sample inlet 156, a first guard inlet 158, and a second guard inlet 160. The packer 154 completely surrounds the outer peripheries of the inlets 156, 158, 160. The guard channel 152 is formed as a recess in the exterior surface of the packer 154. The guard channel 152 includes a central ring section 162 that is spaced from and completely surrounds an outer periphery of the sample inlet 156, a first guard ring section 164 that borders on and completely surrounds an outer periphery of the first guard inlet 158, and a second guard ring section 166 that borders on and completely surrounds an outer periphery of the second guard inlet 160. A first link section 168 extends between the central ring section 162 and the first guard ring section 164, and a second link section 170 extends between the central ring section 162 and the second guard ring section 166.

In the illustrated embodiment, the guard channel 152 is formed in a channel insert 172 that is coupled to the packer 154. For example, the channel insert 172 may be mechanically coupled to the packer 154 such as by forming tabs 174 that are received in anchor slots 176 to form a dove-tail like connection, as best shown in FIG. 12. The channel insert 172 may be made from a low modulus material, such as titanium alloy, to better conform to the wall of the wellbore. It will be appreciated that low modulus materials other than titanium alloy may be used without departing from the scope of this disclosure. The channel may be defined by a structural conduit as shown in FIG. 12, or may be defined by a porous material with integral flow passages.

Figure 13:
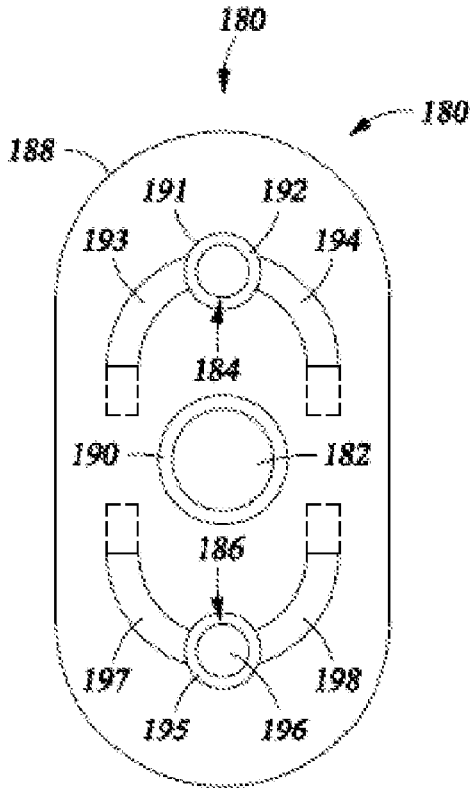
FIG. 13 is a plan view of still another embodiment of a formation fluid sampling system made in accordance with this disclosure.

An alternative assembly using a different guard channel configuration is illustrated in FIG. 13. A guard probe assembly 180 includes a sample inlet 182, a first guard inlet 184, and a second guard inlet 186. A packer 188 completely surrounds the outer peripheries of the sample, first guard, and second guard inlets, 182, 184, 186. A sample inlet channel 190 is provided on an exterior surface of the packer 188 that borders on and completely surrounds an outer periphery of the sample inlet 182. A first guard channel 191 includes a first guard ring section 192 that borders on and completely surrounds an outer periphery of the first guard inlet 184. First and second wings 193, 194 fluidly communicate with the first guard ring section 192 and extend laterally outwardly from opposite sides of the first guard ring section 192. The first and second wing sections 193, 194 are curved to extend toward the sample inlet 182, as shown in FIG. 13. A second guard channel 195 includes a second guard ring section 196 that borders on and completely surrounds an outer periphery of the second guard inlet 186. The second guard channel 195 includes first and second wing sections 197, 198 that fluidly communicate with and extend from opposite sides of the second guard ring section 196. The first and second wings 197, 198 are also curved to extend toward the sample inlet 182.

Figure 14:
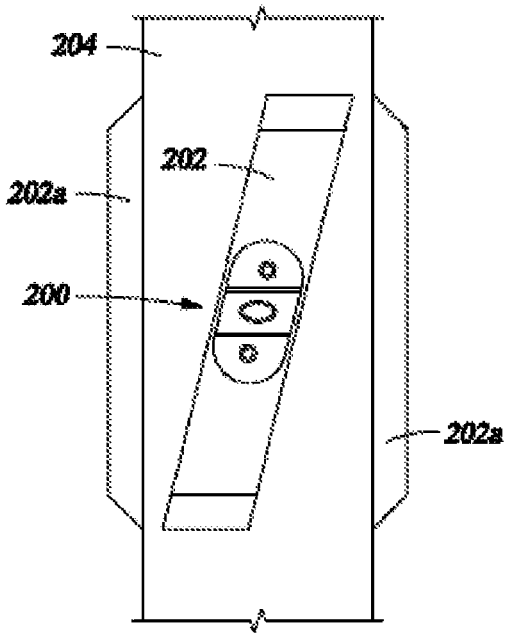
FIG. 14 is a schematic illustration of the formation fluid sampling system housed in an angled stabilizing blade of a drill collar.
Figure 15:
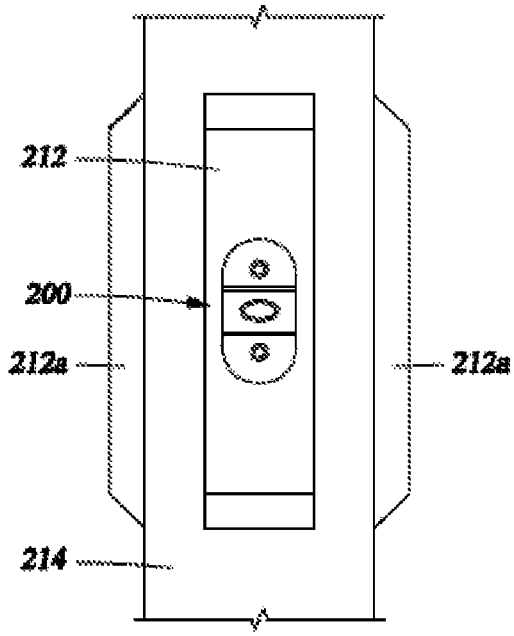
FIG. 15 is a schematic illustration of an alternative formation fluid sampling system similar to that of FIG. 14 housed in a vertical stabilizing blade of a drill collar.

Further alternative embodiments of a probe assembly are illustrated in FIGS. 14 and 15. FIG. 14 illustrates a probe assembly 200 positioned on a probe/stabilizer blade 202 of a drill collar 204, which also includes stabilizer blades 202*a*. The probe/stabilizer blade 202 is angled with respect to a vertical axis of the drill collar 204. In FIG. 14, a probe assembly 210 is shown coupled to a probe/stabilizer blade 212 of a drill collar 214, wherein the probe/stabilizer blade 212 is substantially parallel to a vertical axis of the drill collar 214. The drill collar 214 also includes additional stabilizer blades 212*a*.

Figure 16:
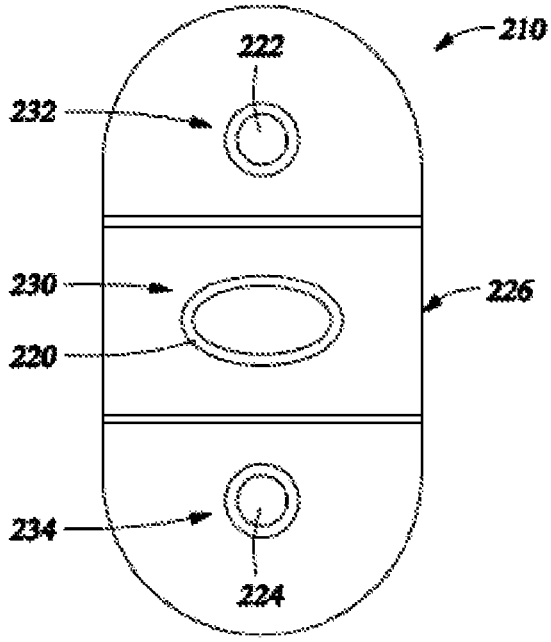
FIG. 16 is an enlarged plan view of the formation fluid sampling system of FIG. 15.

The probe assembly 210 is illustrated in greater detail at FIG. 16. The probe assembly 210 includes a sample inlet 220, a first guard inlet 222, and a second guard inlet 224. Similar to previous embodiments, the inlets 220, 222, 224 are substantially vertically aligned, with the sample inlet 220 positioned between the first and second guard inlets 222, 224.

A composite packer 226 completely surrounds the outer peripheries of the sample inlet 220, first guard inlet 222, and second guard inlet 224. The composite packer 226 may include segments that permit independent extension or retraction of each inlet 220, 222, 224. In the illustrated embodiment, the composite packer 226 includes a sample inlet segment 230, a first guard inlet segment 232, and a second guard inlet segment 234. To independently actuate each probe, a sample inlet extender is operatively coupled to the sample inlet 220, a first guard inlet extender is operatively coupled to the first guard inlet 222, and a second guard inlet extender is operatively coupled to the second guard inlet 224. The segments 230, 232, 234 are shaped so that the composite packer 226 has a substantially contiguous outer periphery. In the illustrated embodiment, the outer periphery has an oval shape.

The sample inlet 220 may be shaped to maximize fluid withdrawal in a circumferential direction while minimizing fluid withdrawal from the formation in a vertical direction. In the illustrated embodiment, the sample inlet 220 has an oval shape with a major axis extending in a substantially horizontal direction and a minor axis extending in a substantially vertical direction, parallel to the wellbore axis. While an oval shape is illustrated, other shapes, including elongate and oblong profiles, may be used without departing from the scope of this disclosure.

Figure 17A:
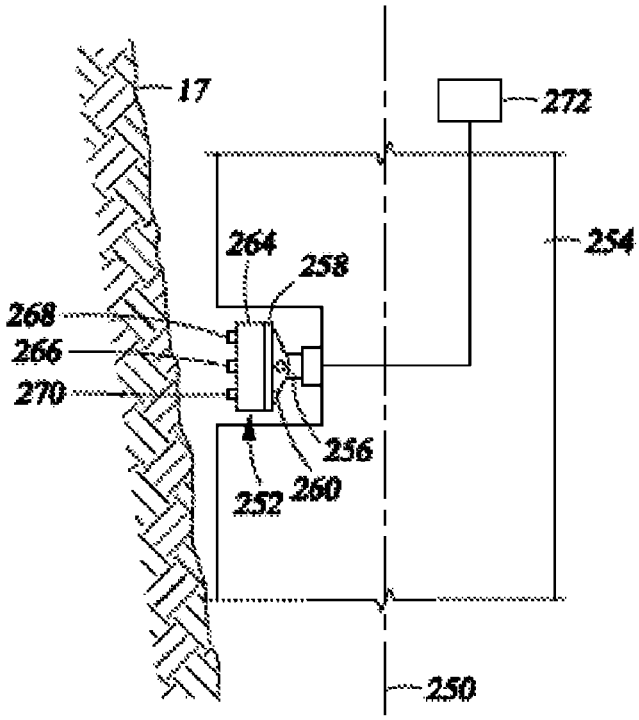
FIGS. 17A and 17B are schematic illustrations of a formation fluid sampling system having a pivotable probe assembly, made in accordance with this disclosure.
Figure 17B:
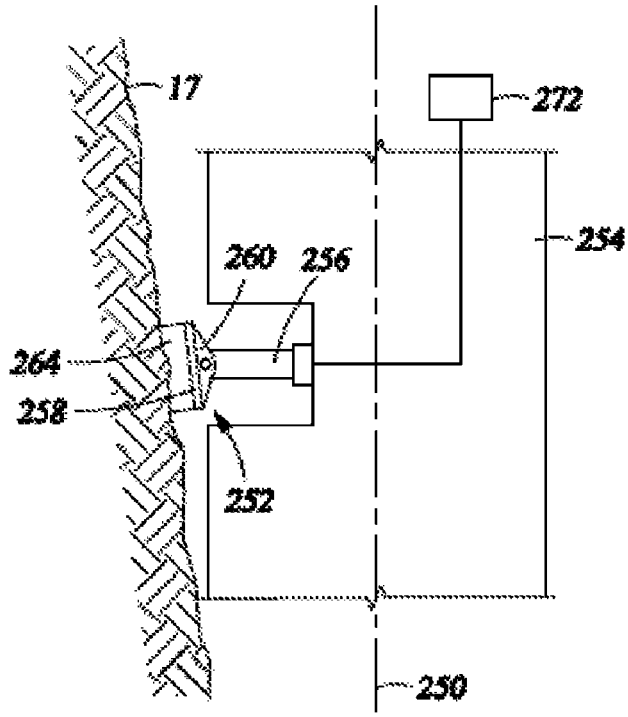

FIGS. 17A and 17B illustrate an alternative embodiment of a sample probe assembly that is pivotable to conform to contour of the wellbore wall, thereby more reliably forming a seal therewith. It will be appreciated that the wellbore wall 17 is not always parallel to an axis 250 of a downhole tool. Consequently, the packer of a probe assembly may be presented at an angle to the wellbore, thereby reducing the ability to sufficiently seal with the wellbore wall. As shown in FIG. 16A, a probe assembly 252 is coupled to a drill collar 254 by a probe extender 256. The probe assembly 252 includes a backing plate 258 having a bracket 260 attached thereto. The bracket 260 is pivotably coupled to an end of the probe extender 256. The backing plate 258 carries a packer 264, a sample inlet 266, a first guard inlet 268, and a second guard inlet 270. The probe extender 256 may be provided as an actuating cylinder that is operatively coupled to a power supply, such as a source of hydraulic fluid 272.

In operation, the probe extender 256 may be actuated to move the probe assembly 252 from a retracted position where the assembly is spaced from the wellbore wall 17, shown in FIG. 17A, to an extended position where the assembly engages the wellbore wall 17, shown in FIG. 17B. The pivotable connection between the extender 256 and the backing plate 258 allows the packer 264 to tilt complementary to the wellbore wall 17, thereby more reliably sealing with the wall.

Figure 18:
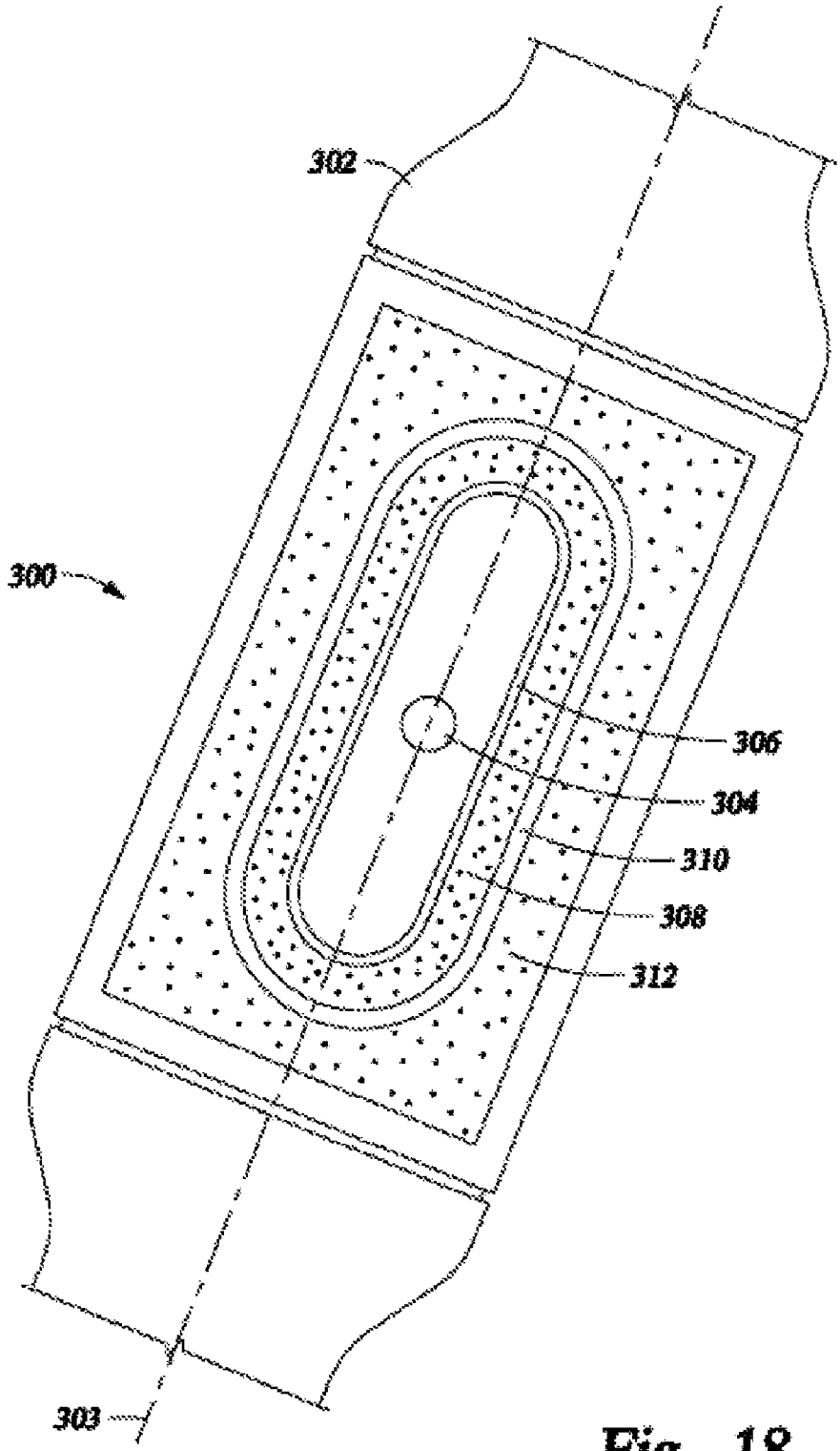
FIG. 18 is a schematic illustration of yet another embodiment of probe assembly, in which the inlet is elongated for use on a stabilizing blade of a drill collar.

FIG. 18 illustrates a further embodiment of a probe assembly 300 having an elongated profile to provide improved fluid flow while meeting the size constraints associated with use in a stabilizing blade 302 of a drilling tool, such as drilling collar 307. The probe assembly 300 is housed within a cavity 309 formed in the blade 302 so that the assembly 300 may be recessed during drilling operations. An extension mechanism (not shown) is provided to extend the assembly 300 into contact with the wellbore wall to perform sampling operations.

The assembly 300 includes a sample inlet 304 having an expanded mouth portion 306. The mouth portion 306 is elongated along a longitudinal axis 303 of the blade 302 to provide an enlarged communication surface for engaging the formation. More specifically, the mouth portion has a first profile dimension in a direction parallel to the blade axis 303 and a second profile dimension in a direction perpendicular to the blade axis 303, in which the first profile dimension is greater than the second profile dimension. In the illustrated embodiment, the mouth portion has a generally oval shape cross-sectional profile, with the first profile dimension comprising a major axis and the second profile dimension comprising a minor axis. To meet the space restrictions presented by the blade stabilizer, the second profile dimension may be less than approximately 3.5 inches.

The sample inlet 304 is surrounded by an inner packer 308. An oval-shaped guard inlet 310 completely surrounds the inner packer 308 and sample inlet 304. The guard inlet 310 has a profile that is elongated along the longitudinal axis of the blade, similar to the sample inlet 304. An outer packer 312 surrounds a periphery of the guard inlet 310. The inner and outer packers 308, 312 have a thickness and/or are formed of a material that provides sufficient strength to withstand the pressure differentials generated during operation of the probe assembly 300.

The probe assembly 300 illustrated in FIG. 18 is particularly suited for use in a stabilizing blade 302 in while-drilling applications. As noted above, it is desirable to minimize the size of the inlets to maintain structural integrity of the drill collar. When provided within a stabilizing blade, inlet size is further restricted by the dimensions of the blade, particularly the relatively narrow width of the blade. As a result, the guard inlet must be reduced from a width of 4-10 inches or more (as is typical for wireline applications) to approximately 3.5 inches or less to fit within the stabilizing blade. This disclosure is not limited to these specific dimensions, as the size of the guard inlet may be commensurate with the overall dimensions of the wellbore or the tool in which the guard inlet resides. After leaving sufficient room for the inner packer 308, only a relatively narrow space is left for the sample inlet 304. The sample inlet 304, however, must have a communication area that engages the formation that is sufficiently large to ensure adequate liquid flow. The elongated, oval shape of the mouth portion 306 increases the communication area of the sample inlet 304 while meeting space restrictions imposed by the blade structure.

With the increased communication area provided by the mouth portion 306, it can be more difficult to form a sufficient seal between the packers 308, 312 and the formation, since the increased contact area is more likely to encounter ruggosity or other formation surface deviations. The pivotable probe head discussed above in connection with FIGS. 17A and 17B may be employed with the elongated profile to minimize the effects of formation surface irregularities.

While only certain embodiments have been set forth, alternatives and modifications will be apparent from the above description to those skilled in the art. These and other alternatives are considered equivalents and within the spirit and scope of this disclosure and the appended claims.

What is claimed is:

1. A downhole tool configured to be conveyed in a wellbore penetrating a subterranean formation, comprising:

an inlet extension mechanism; and a probe assembly pivotably coupled to the inlet extension mechanism and comprising:

a sample inlet comprising:

a first profile dimension in a direction parallel to an axis of the wellbore; and a second profile dimension in a direction perpendicular to the wellbore axis, in which the first profile dimension is greater than the second profile dimension;

an inner packer completely surrounding an outer periphery of the sample inlet;

a guard inlet extending completely around an outer periphery of the inner packer; and an outer packer completely surrounding an outer periphery of the guard inlet.

* * * * *